United States Patent [19]

Tikka et al.

[11] Patent Number: 4,895,618

[45] Date of Patent: Jan. 23, 1990

[54] METHOD OF CONTROLLING ALKALINE PULPING PROCESS

[75] Inventors: Panu Tikka; Nils-Erik Virkola, both of Helsinki, Finland

[73] Assignee: Afora OY, Helsinki, Finland

[21] Appl. No.: 330,954

[22] Filed: Mar. 23, 1989

Related U.S. Application Data

[63] Continuation of Ser. No. 136,507, Dec. 28, 1987, abandoned, which is a continuation of Ser. No. 825,089, Jan. 31, 1986, abandoned, which is a continuation-in-part of Ser. No. 794,178, Nov. 1, 1985, abandoned.

[51] Int. Cl.[4] ..... D21C 7/12

[52] U.S. Cl. ..... 162/49; 162/62; 210/798; 436/179

[58] Field of Search ..... 162/49, 61, 62, 238, 162/DIG. 10; 210/798, 96.1, 739, 746, 745, 743, 411, 412; 436/177, 178, 179

[56] References Cited

U.S. PATENT DOCUMENTS

| | | | |
|---|---|---|---|
| 4,153,547 | 5/1979 | McLean | 210/798 |
| 4,345,913 | 8/1982 | Jönsson | 162/49 |
| 4,409,853 | 10/1983 | Chase et al. | 162/49 |
| 4,540,468 | 9/1985 | Genco et al. | 162/49 |
| 4,617,131 | 10/1986 | Walker | 210/798 |

FOREIGN PATENT DOCUMENTS

| | | |
|---|---|---|
| 873574 | 10/1982 | Finland . |
| 69132 | 1/1986 | Finland . |

OTHER PUBLICATIONS

Kesler; "Analysis of Alkaling Pulping Liquors"; *Tappi,* vol. 46, No. 7, Jul. 1963, pp. 442–445.

*Primary Examiner*—Steve Alvo

[57] ABSTRACT

A method of controlling an alkaline pulping process, sulphate pulping in particular. The concentration of the dissolved components as well as the concentration of the recidual cooking chemical are measured. The measurements are carried out by means of an analyzer positioned outside of the cooking process in a separate liquid flow. The measuring devices are per se known detectors. The cooking process is observed and the necessary corrections are made on the basis of the measuring results.

1 Claim, 3 Drawing Sheets

METHOD OF CONTROLLING ALKALINE PULPING PROCESS

This application is a continuation, of application Ser. No. 07/136,507. filed Dec. 28, 1987 and now abandoned, which is a continuation, of application Ser. No. 06/825,089, filed Jan. 31, 1986 and now abandoned, which is a continuation-in-part of Ser. No. 06/794,178, filed Nov. 1, 1985 and now abandoned.

The invention relates to a method of controlling alkaline pulping processes, especially sulphate pulping, in which method the components dissolved from wood and the residual inorganic cooking chemical are measured from the process liquors by means of a rapid analyzer apparatus.

The object of the invention was to provide a method of obtaining measuring data on the concentrations of the cooking chemical and the reaction product of alkaline pulping processes at short intervals for controlling the cooking on the basis of the factual proceeding thereof.

The object of the invention is achieved by feeding a small sample taken from the process into a separate analyzer liquid flow having accurately uniform conditions, in which flow the sample, after having been diluted therein under the influence of diffusion, flows as a peak-shaped zone having a nearly normally distributed concentration through different kind of measuring devices operated on the flow-through principle. Lignin dissolved from wood is measured on the basis of the absorption of the ultraviolet radiation at the wave length of an extreme point (e.g. 205 or 280 nm) of the UV-spectrum of lignin; the total amount of the dry matter dissolved from wood is measured on the basis of the difference in the refraction index in relation to a pure flowing medium by means of a differential refractometer; the residual active alkali being measured by a conductivity measurement. In addition, the liquid flow can be passed through any measurement carried out on the flow-through principle in order to provide further measurings. Obtaining data from the above-mentioned measurements involves the principle that the alkali concentration measured at the beginning of the cooking and during the proceeding thereof is used as grounds for setting an objective for the end point of the cooking, the attainment of said objective being then observed and, if required, corrected by means of measurements of the reaction products. In other words, the cooking is here controlled both by means of a "feed forward" control directed forwards and a "feed back" control connected backwards. Both ways of controlling have been suggested to be effected by means of different kinds of direct measurements carried out from the process pipelines or by means of automatic titrators. The novelty of the present invention lies in that the arrangement according to the present method combines all ways of control by providing the necessary data by means of a single apparatus and from one and the same sample. The present measuring technique is particularly advantageous in that the measurements are independent of any changes of the zero point, because there is always returned to the zero between the measurements and there are measured only the differences caused by the sample in the quantity to be measured in relation to time. Further, the measuring devices are not at all liable to become contaminated, as the sample is diluted and a pure measuring medium flows between the samples.

At present, controlling of alkaline pulping processes, sulphate pulping in particular, is based on the fact that it has been possible to develop a mathematical model, a so called H-factor, on lignin dissolution occuring during the cooking, said model taking into consideration the cooking chemical charge, the digesting temperature and the digesting time, as appears from the publication Rekunen, S., Jutila, E., Lähteenmäki, E., Lönnberg, B., Virkola, N-E., Examination of reaction kinetics in kraft cooking. Paperi ja Puu 62 (1980):2, 80–90). This kind of model operates fairly satisfactorily, provided that the cooking conditions as well as the quality and humidity of the wood chips are known. However, this is not usually the case at any single plant, but the conditions vary at random, and, although important for the process control, such quantities as humidity, quality and particle size distribution characterizing the raw material, i.e. chips, are left beyond the possibilities of the present measuring techniques. Attempts have been made to improve the situation by carrying out different kind of measurements from the digester liquors. The amount of the cooking chemical or active alkali has been measured either by conductivity measurement directly from a process pipeline system in a manner disclosed in the publication Lundqvist, G., Alkali analysis by conductivity measurements. Svensk Papperstid 76 (1972): 9, 524–527 or by an automatic microprocessor-controlled titration from the cooking liquid sample, which, in turn, is known from U.S. Pat. Nos. 4,104,028 and 4,012,197 as well as from the publication Wallin, G., Noreus, S., Computer control of batch digesters. Svensk Papperstid 76 (1973): 9, 329–334. A disadvantage of a direct conductivity measurement, however, is that the process pipelines are extremely liable to get contaminated, which results in slipping of the zero point and difficulties in the compensation thereof. Fairly reliable information is obtained on the active alkali by means of titrators, which, however, are slow and, besides, a single point per process in the initial stages thereof does not yet disclose the profile of the alkali consumption nor the residual alkali providing perhaps the most important grounds for forward control in view of the determination of the end point.

Attempts have also been made to measure lignin dissolved from wood and to determine the end point of the cooking on said grounds. In particular, the absorption of the ultraviolet radiation has been used in Kleinert, T.N., Joyce, C. S., Short wavelength ultraviolet absorption of various lignins and related substances. UV lignin determination in sulphate pulping liquor. Pulp and pap.-mag.of Can. 58 (1957): 11, 147–152; Williams, D. J., The application of the ultraviolet absorption characteristic of lignin to the control of pulp uniformity. Appita 22 (1968):2, 45–52; Capart, R., Obese -Decty, K-, Le Cardinal, G., Gelus, M., Contribution to on-like kraft pulping control. IFAC PRP 4 automation, Ghent, Belgium 1980, p. 121–128. These methods are greatly disadvantageous in that they are continuously operated, whereby they are difficult to control with respect to contamination and, even the more, with respect to the extensive continuous dilution. On account of technical difficulties, lignin measurements have not been put to constant use in process control. Besides, it can be estimated that a mere lignin concentration without any information on the alkali concentration and the properties of the chip filling can not provide a reliable basis for the determination of the end point.

No mention of a combined use of the above-mentioned measurements nor of carrying out the same by a single apparatus and from one and the same sample has been found in literature.

The present invention combines the separate determinations mentioned in the above literature above by means of a novel technique and by elimination of certain previously encountered factors which reduce the reliability of the measuring results, and simultaneously enables in principle an unlimited number of different flow-through measurements to be carried out from one and the same sample.

Figure 1:
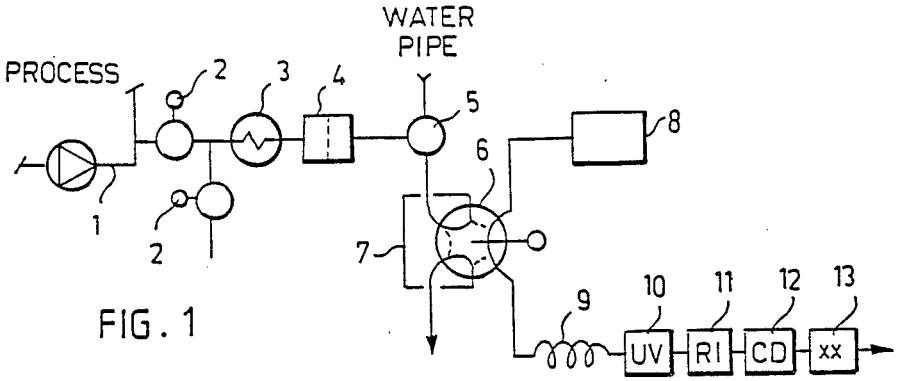
FIG. 1 illustrates an analyzer apparatus for observing and controlling alkaline cooks.
Figure 2:
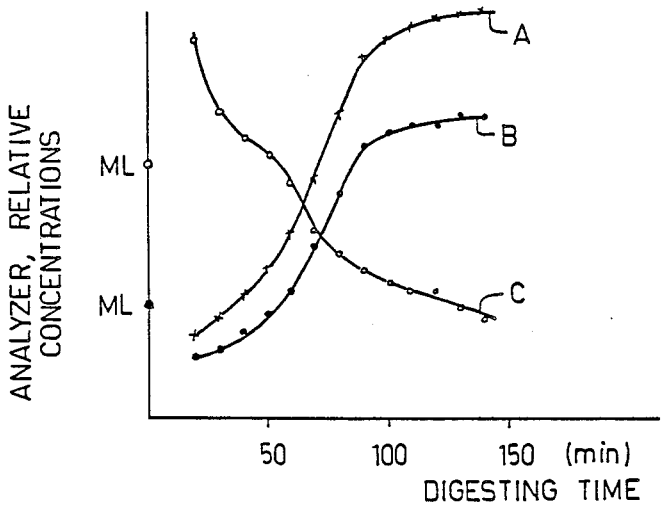
FIG. 2 illustrates proceeding of a plant-scale sulphate batch pulping as a function of the digesting time, curve A representing the lignin content, curve B the dry matter content and curve C the residual alkali content.
Figure 3A:
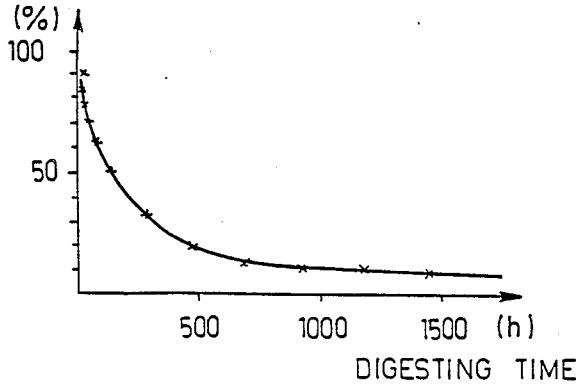
FIGS. 3A and 3B show lignin dissolution curves calculated on the basis of the lignin measuring results of the analyzer, said curves concerning a plant-scale sulphate, pulping process as a function of the pulping time.
Figure 3B:
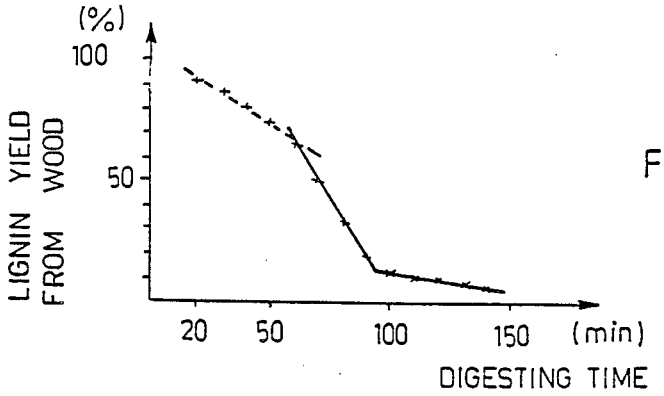
Figure 4A:
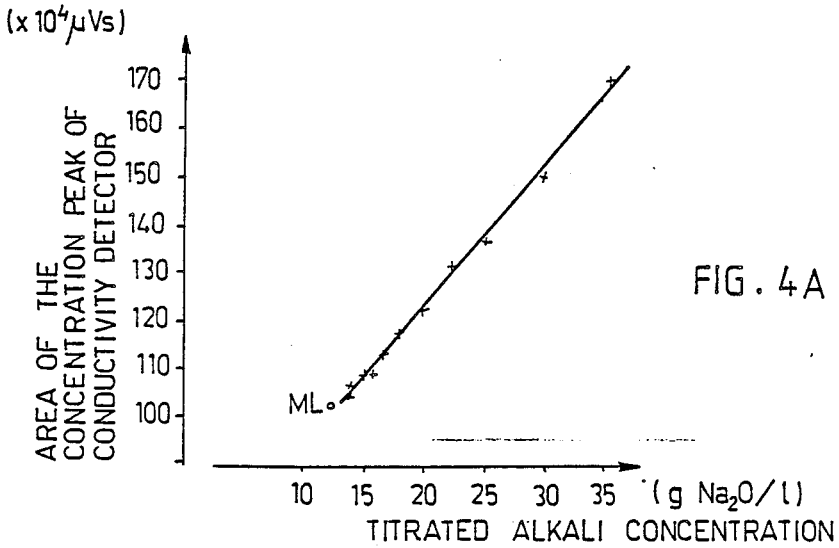
FIGS. 4A and 4B show a relative alkali concentration measured by the analyzer from a plant-scale sulphate batch pulping as a function of an alkali titration carried out in a laboratory.
Figure 4B:
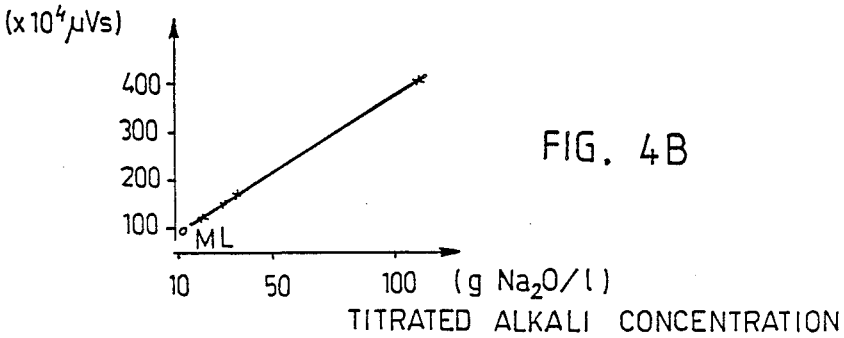
Figure 5:
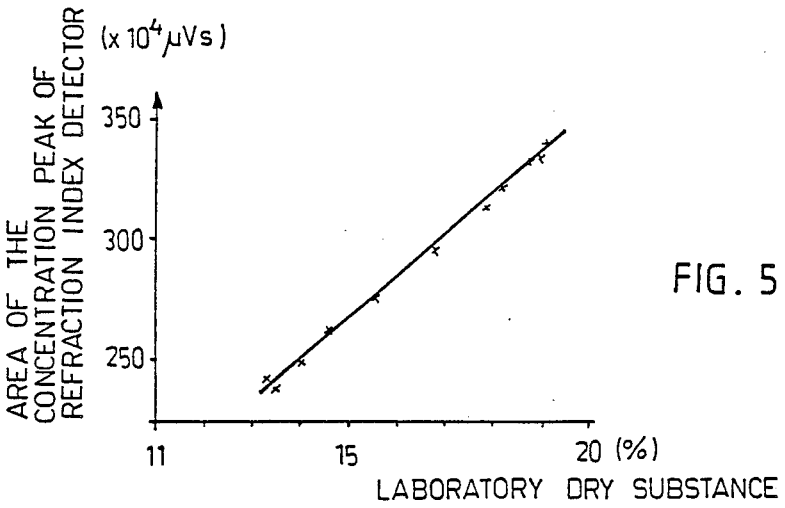
FIG. 5 shows a relative dry matter content measured by the analyzer from a plant-scale sulphate batch pulping as a function of a dry matter content determination carried out in a laboratory.

According to FIG. 1, a small sample is taken from a process pipeline, e.g. from a delivery-side 1 of a pump (a circulation pump of a batch digester or a circulating pump of one cycle of a continuously operated digester) by means of a valve 2, which sample is cooled in a condenser 3 and filtered in a sinter filter 4 and then passed through a normal position of a wash valve 5 to a loop 7 of a loop-injection valve 6. When a necessary amount of the sample, from the point of view of representativeness (with a tube size of ⅛" about 50 ml), has passed through the loop, the injection valve 6 turns over 60° and a separate liquid (8) of the analyzer a pump or a pressurized liquid container is conducted through the loop, thus taking therewith an uniform volume (the loop being 25 microliters) of the sample. In the analyzer liquid flow (usually pure water but also a diluted alkali or an alkalic buffer solution is possible), the sample is diluted in a long capillary tube 9 (5–6 m $\phi$0.8 mm teflon capillary) under the influence of diffusion without any artificial dilution steps and the diluted sample zone flows through different kinds of measuring devices: an ultraviolet or UV-detector 10 measuring the lignin concentration of the sample on the basis of the absorption of the ultraviolet radiation (205 or 280 nm); a refraction index or RI-detector measuring the dry matter content of the sample on the basis of a difference in the refraction indices; and a conductivity detector 12 measuring the concentration of the residual active alkali on the basis of the conductivity of hydroxyl ions. In addition, the flow can be passed through other measurements (xx) 13 operated on the flow-through principle, such as e.g. ion selective electrodes, pH-electrodes and an addition of a neutralizing chemical, the active alkali and sulphidity being thereby determined by means of the reaction heat and changes in the conductivity.

Measuring signals of the different detectors from the diluted sample zone are integrated as a function of time, i.e. the areas of the concentration peaks are calculated, thus directly obtaining the relative concentrations of the sample, when the analyzer liquor flow is run at a standard rate. If desired, the relative concentrations can be modified into the actual ones, e.g. g/l, by running samples analyzed in a laboratory in order to form a calibration curve.

When the sample zone has advanced in the analyzer into the dilution capillary, washing of the sample line begins immediately. Said valve 5 passes the water upstream through the filter 4 and the condenser 3 and the washing water is discharged through a valve.

The analyzer arrangement according to the invention has the following advantages:

The sample amount required is small (50 ml), which is of advantage as the dry matter content of such a small sample is low and so the filter can easily be kept clean by a simple counter-current wash. In industrial test runs, a sinter filter having a diameter of 30 mm has remained completely clean through thousand of analyses.

Complicated dilution devices required by the UV-devices mentioned in literature are not at all necessary. The dilution is effected spontaneously in a long capillary tube under the influence of diffusion.

The measurements are completely independent of shiftings of the zero points of the measuring devices, because only a difference caused by the sample zone is measured and there is always returned to the zero point between the measurements, whatever it may be.

The measuring devices remain almost clean, because the sample is very diluted and a pure measuring medium flows between the samples.

All measuring conditions are made accurately constant by maintaining the temperature of the measuring devices and, the measuring medium constant.

By virtue of the integration principle, small variations if the operation of the apparatus or in the shape of the dilution zone do not cause any disturbances.

EXAMPLE 1

Use of the analyzer apparatus for observing a plant-scale sulphate batch pulping process in accordance with the invention.

An industrial sulphate batch digester was observed by means of the analyzer apparatus of FIG. 1 with sampling intervals of 10 minutes by taking a sample from the delivery-side of a calorisator pump of the digester. The volume of the digester was 180 $cm^3$, the wood species was pine, the alkali charge 21% calculated on the amount of wood, the sulphidity being 30% and the digesting temperature 170° C. In the apparatus of FIG. 1, the flowing liquid of the analyzer was pure water; a hose pump was used as a liquid flow source 8; the flow rate was 4 ml/min, the volume of the sampling loop 7 was 25 $\mu$l, the length of the diffusion dilution capillary 9 was 5 m and the diameter thereof 0.8 mm. The UV-detector 10 was a Knauer UV/VIS Photometer, the wave length being 280 nm; the refraction index detector was a Knauer Differential Refractometer; and the conductivity detector a Vydac Conductivity Detector. The electrical signals of the detectors were integrated by means of an eight-bit SELMA-microprocessor and a self-made integrator program. With this way of measuring, the analyzing time for one sample was about four minutes.

EXAMPLE 2

Figure 6:
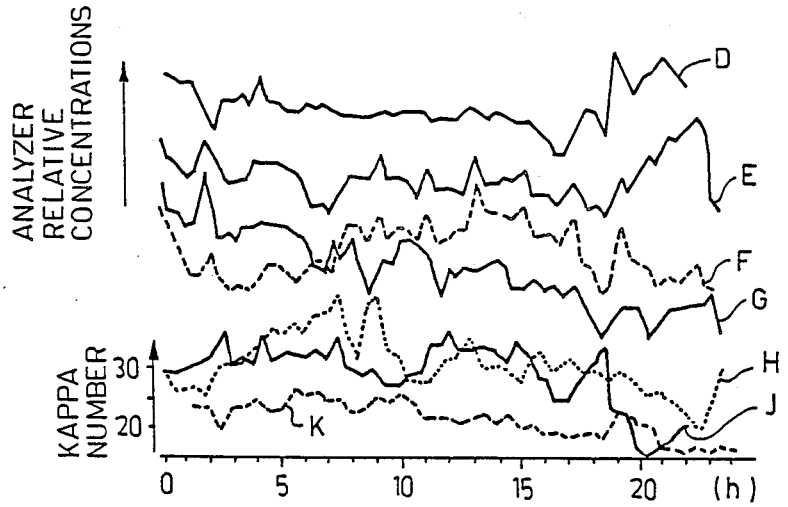
FIG. 6 illustrates observation of a continuously operated sulphate pulping process, curve D representing the alkali concentration equalizing cycle, curve E the residual alkali concentration in the outgoing black liquor, curve F the lignin concentration in the outgoing black liquor, curve G the lignin concentration in the terminating cycle, curve H the lignin concentration in washing cycle, curve J the lignin concentration equalizing cycle and curve K kappa number of pulp from digester.

Use of the analyzer apparatus for observing a plant-scale continuously operated sulphate pulping in accordance with the invention, The procedure was similar to Example 1 except that different cycles of a continuously operated sulphate digester were observed, said cycles being equalizing, outgoing black liquor, terminating and washing. The analyzer took a sample about every five minutes by moving from one cycle to another, whereby the analyzing interval of one cycle was 20 minutes. The results appear from FIG. 6.

We claim:

1. A method of sampling process liquor from an alkaline pulping process wherein said process liquor contains components including reaction product components and residual cooking chemicals flowing through a process pipeline of a digester, comprising the steps of:

(a) first, taking a sample of the process liquor from said process pipeline to a sample line;

(b) second, passing said sample along said sample line through a filter;

(c) third, isolating from said sample which has passed through the filter a smaller sample of a selected volume;

(d) fourth, diluting said smaller volume of sample with a flowing liquid to produce a diluted sample;

(e) fifth, passing said diluted sample including diluting flowing liquid through a capillary tube to produce mixing by diffusion;

(f) sixth, flowing said mixed diluted sample through measuring devices for measuring reaction product compounds and residual cooking chemicals to produce a signals indicative of selected properties of said sample; and (g) seventh, washing said sample line and said filter by passing a washing medium through the sample line and filter in a direction opposite the direction in which said sample passes therethrough.

* * * * *